US007219880B2

(12) United States Patent
Huang et al.

(10) Patent No.: US 7,219,880 B2
(45) Date of Patent: May 22, 2007

(54) SAFETY PROTECTION DEVICE AND CONTROL CIRCUIT FOR INSTANTANEOUS ATOMIZATION DEVICE

(76) Inventors: Chuan-Pan Huang, No. 17, Hsinjen Rd., Tainan City (TW); Chen-Lung Huang, No. 17, Hsinjen Rd., Tainan City (TW)

( * ) Notice: Subject to any disclaimer, the term of this patent is extended or adjusted under 35 U.S.C. 154(b) by 93 days.

(21) Appl. No.: 11/115,770

(22) Filed: Apr. 26, 2005

(65) Prior Publication Data

US 2006/0237860 A1 Oct. 26, 2006

(51) Int. Cl.
*B01F 3/04* (2006.01)

(52) U.S. Cl. ..... 261/72.1; 261/81; 261/DIG. 48; 261/DIG. 65

(58) Field of Classification Search ..... 261/66, 261/72.1, 81, 119.1, 142, DIG. 48, DIG. 65
See application file for complete search history.

(56) References Cited

U.S. PATENT DOCUMENTS 3,561,444 A * 2/1971 Boucher ..... 128/200.16
3,828,773 A * 8/1974 Buch et al. ..... 128/200.16
4,643,351 A 2/1987 Fukamachi et al. ..... 236/44
4,731,204 A * 3/1988 Noma et al. ..... 261/30
4,738,806 A * 4/1988 Noma et al. ..... 261/81
5,176,856 A * 1/1993 Takahashi et al. ..... 261/142
5,563,811 A * 10/1996 Embree ..... 702/86
6,135,427 A * 10/2000 Tsai ..... 261/26
6,462,314 B1 * 10/2002 Huang et al. ..... 219/501
6,854,718 B1 * 2/2005 Liu ..... 261/81

FOREIGN PATENT DOCUMENTS

| | | |
|---|---|---|
| TW | 174507 | 12/1991 |
| TW | 189066 | 8/1992 |
| TW | 470209 | 12/2001 |
| TW | 584336 | 4/2004 |

* cited by examiner

*Primary Examiner*—Scott Bushey

(57) ABSTRACT

An atomization device having a safety protection device and a control circuit includes: a main body, a water tank in which an inspection device component is provided, and an atomization room designed in the main body, under the atomization room an atomization groove with a safety protection device is designed for the safety of user. The safety protection device is equipped with a shell comprising upper and lower covers. A nebulizer is placed in the shell, and protective panel is designed under the nebulizer. The protective panel will be combined well with a ring-shaped cover to separate the protective panel from the nebulizer properly.

13 Claims, 6 Drawing Sheets

SAFETY PROTECTION DEVICE AND CONTROL CIRCUIT FOR INSTANTANEOUS ATOMIZATION DEVICE

FIELD OF THE INVENTION

The present invention provides a safety protection device and a control circuit for an instantaneous atomization device, particularly a safety protection device, which is designed in an atomization groove of the main body. And a nebulizer is designed in a shell based on the safety protection device, the periphery of the nebulizer is covered by a ring-shaped cover, and a protective panel is designed under the nebulizer. The protective panel will be combined well with the aforesaid ring-shaped cover to separate the protective panel from nebulizer properly. The protective panel is electrically connected to a control circuit. Accordingly, when the nebulizer is damaged by external impact insulting in water leakage, the protective panel can be used for holding the water and the water would not seep into the main body. And the protective panel can detect the water leakage and drive the control circuit to break off the power of the nebulizer immediately so as to assure the operation safety of an instantaneous atomization device.

BACKGROUND OF THE INVENTION

According to the prior humidistat (or atomization device), such as the ultrasonic oscillator humidistat disclosed in U.S. Pat. No. 4,643,351, FIG. 6 of this prior patent indicates that a nebulizer or ultrasonic oscillator 15 is set at the bottom of the atomization device. Regardless of the ultrasonic oscillator or heater this device equipped, when external force results in the damage of the ultrasonic oscillator or heater, the water in the atomization device will flow through the damaged ultrasonic oscillator or heater and seep into the main body and damage the oscillating circuit 10 of the ultrasonic oscillator or heater, even result in short circuit and unexpected damage.

Additionally, in the abovementioned U.S. Pat. No. 4,643,351's ultrasonic oscillator humidistat, when the control circuit detects a low water level, it will cut off the power. However, it fails to teach cutting off the power in time when there is a water leakage in the nebulizer for preventing water leakage and damage in the case of water leakage.

Furthermore, FIG. 1 shows a conventional control circuit for the water leakage and power break of atomization device, which mainly uses a zero phase electric sensor T1 to judge the phase (difference of voltage) change between input power and driving circuit 5, accordingly the power of the nebulizer would be cut off in time. However, the zero phase electric sensor T1 would cause different voltage of V1 and V2 on both side ends for the damaged nebulizer, and the changeable voltage of the AC would have adverse effect and cause error action of control circuit and puzzle user, further increase the risk of product. And it was common to take the zero phase electric sensor T1 as judger at that time, such as Taiwan Patent No. 174507 breaker with power leakage alarming function, No. 189066 Short, broken circuit inspection system, No. 470209 Simple protective circuit for power leakage and over current, and No. 584336, protective device for appliance etc.

To overcome the defects of conventional atomization devices and control circuits for the water leakage abovementioned, the inventor of the present invention researches and provides this invention particularly.

SUMMARY OF THE PRESENT INVENTION

One purpose of the present invention is to provide an atomization device having a control circuit, which can cut off the power in time when the nebulizer is damaged and water leakage occurs so as to improve the operation safety of the atomization device.

Another purpose of the present invention is to provide an atomization device having a safety protection device, which can hold the water leaked from a damaged nebulizer and prevent water from seeping into the main body to result in failure or damage of control circuit of the main body for good performance of the atomization device.

The present invention has the following features:

1. A safety protection device and a control circuit are provided for the instantaneous atomization device of the present invention. The safety protection device is designed in an atomization groove to secure the control circuit in the main body and to protect the user.

2. The present invention provides a safety protection device and a control circuit for instantaneous atomization device, wherein the safety protection device is designed in an atomization groove to protect the nebulizer and properly separate a protective panel from the nebulizer. Accordingly, when the nebulizer is damaged by external impact causing water leakage, the aforesaid protective panel can be used for holding the water and the water would not seep into the main body. And the protective panel can detect the water leakage and drive the control circuit to break off the power of the nebulizer immediately for application safety of an instantaneous atomization device.

3. The present invention provides a safety protection device and a control circuit for an instantaneous atomization device, wherein a protective panel of the safety protection device is electrically connected to the control circuit. When the protective panel detects water leakage, the control circuit can control the circuit based on the V3 voltage change of the resistance R4 and cut off the power of the nebulizer in time and effectively.

DETAILED DESCRIPTION OF PREFERRED EMBODIMENTS

Figure 3:
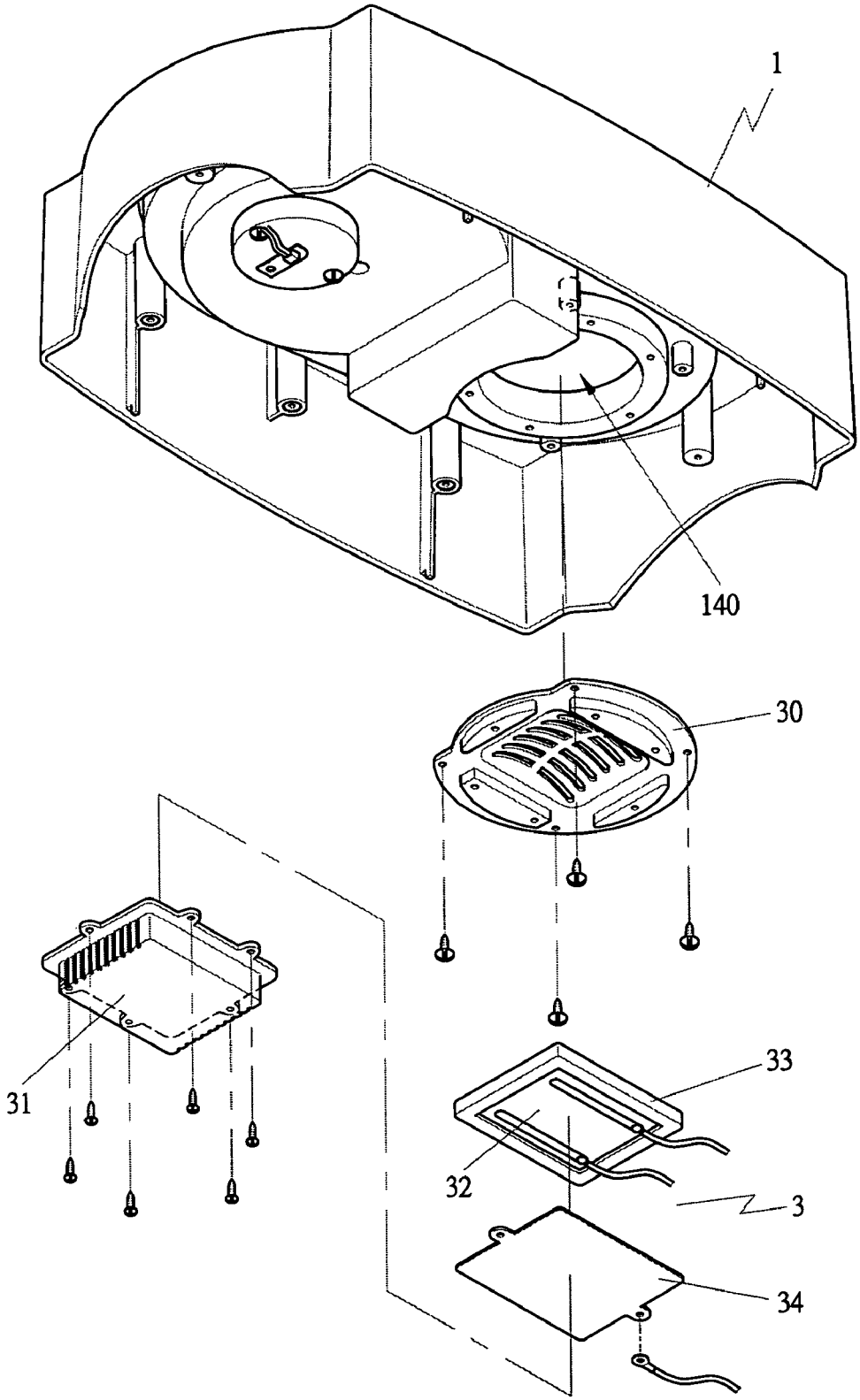
FIG. 3 is a partial exploded view of an atomization device of the present invention.
Figure 4:
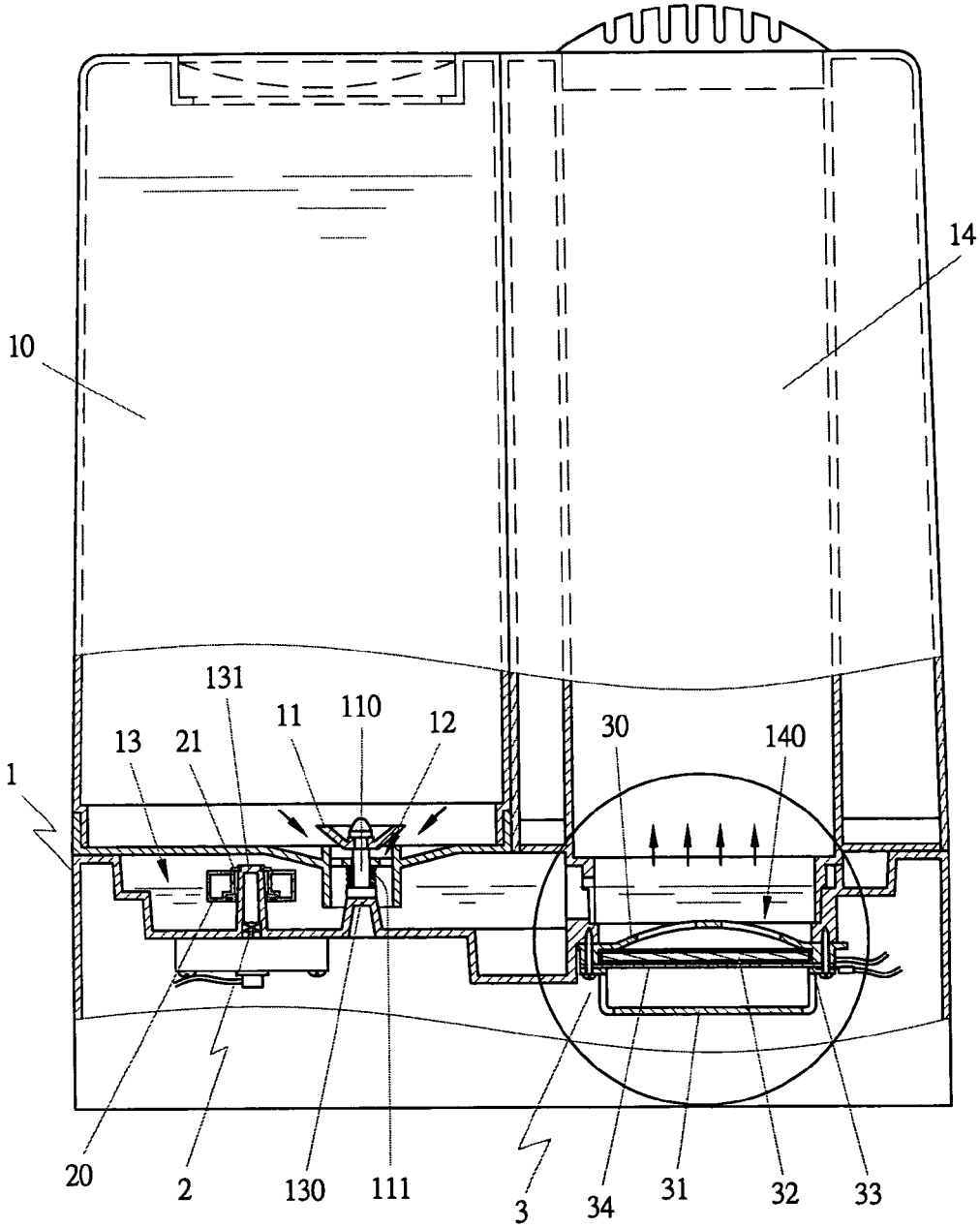
FIG. 4 is a partial cutaway view of an atomization device of the present invention.

Therefore, for better understanding of the present invention, the present invention is described in connection with the drawings as below:

As shown in FIGS. 3 and 4, the present invention provides an instantaneous atomization device having a safety protection device and a control circuit. The atomization device comprises a main body 1 with a water tank 10 detachably coupled to the main body, so that water can be loaded conveniently. And the water tank 10 has a large capacity in water storage. There is a water outlet valve 11 which has a valve pole 110 designed at the bottom wall of water tank 10. The valve pole 110 goes through a water outlet 12 and a spring 111. The lower end of valve pole 110 rests on a water outlet valve post 130 in a water trough 13 to keep proper water lever of the water trough 13 and control the water level of an atomization groove 140 for proper level, accordingly the water in the atomization groove 140 can be quickly atomized. Under the water tank 10 a water trough 13 is designed. A upright hollow post 131 is positioned in the water trough 13. The upright post 131 can contain an inspection component 2, which can be a photoelectric or magnetic sensor, such as Reed sensor, Hall IC and so on (because the inspection sensor is well known, it is not shown in the drawings). Furthermore, the upright post 131 can be engaged with a floating ball 20, and controlled by a limitation component 21, so that the floating ball 2 is designed on the upright post 131 of the main body 1 and the floating ball 20 can work with the inspection sensor abovementioned. An atomization room 14 is designed in the main body 1. Under atomization room 14 is an atomization groove 140. A safety protection device is provided under atomization groove 140 for the operation safety.

Figure 5:
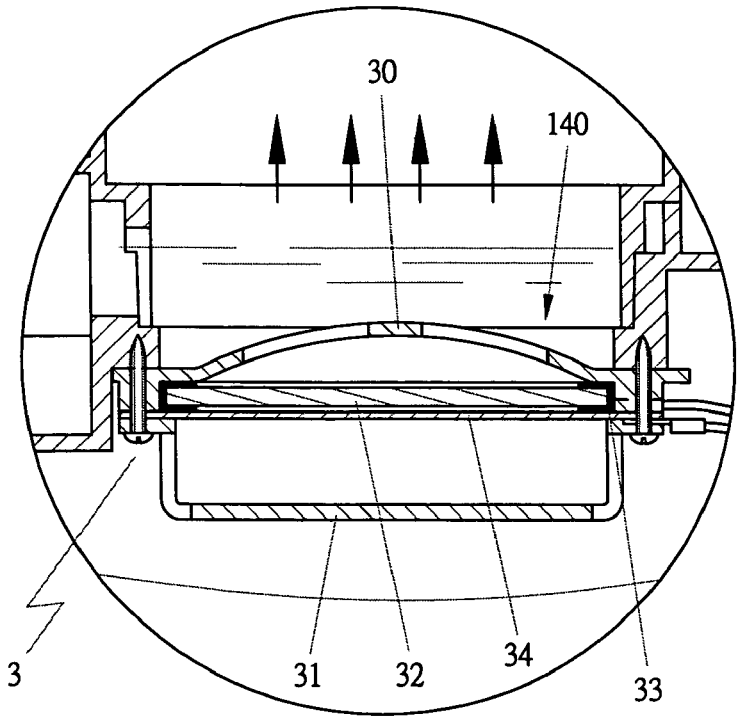
FIG. 5 is an enlarged partial cutaway view of an atomization groove and a safety protection device of the present invention.
Figure 6:
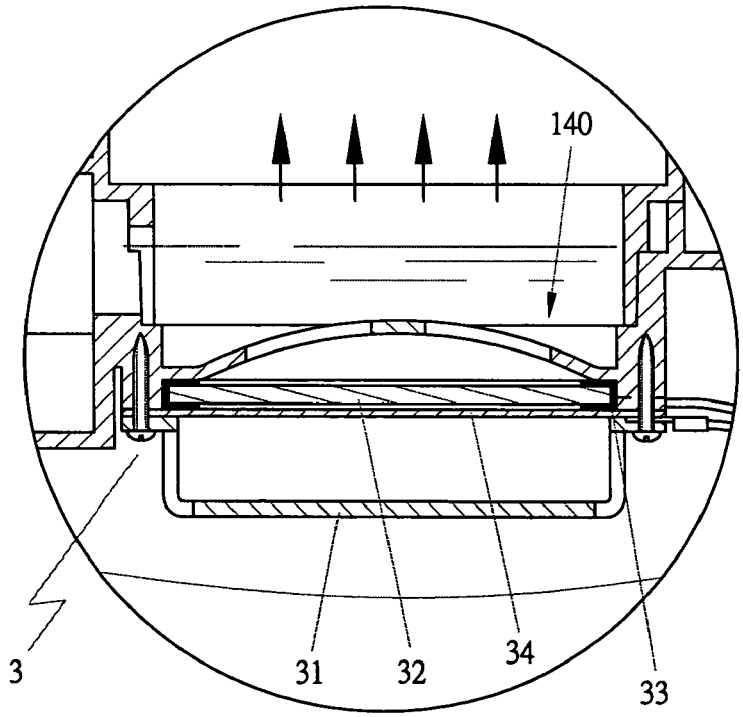
FIG. 6 is an enlarged partial cutaway view an atomization groove and a safety protection device according to another embodiment of the present invention.
Figure 7:
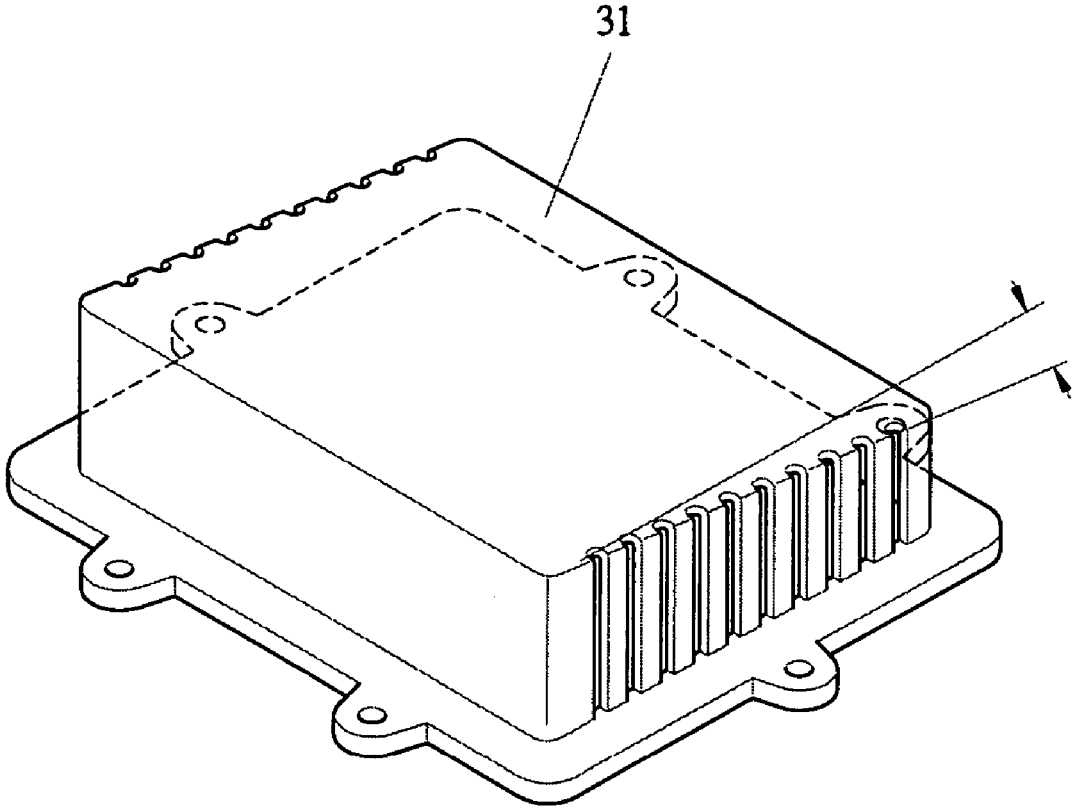
FIG. 7 is a perspective view of a safety protection device of the present invention.

The safety protection device 3 (as shown in FIGS. 3, 5 and 7) is designed in the atomization groove 140 and is equipped with a shell comprising upper and lower cover 30, 31. The upper cover 30 can be made detachable from the main body (as shown in FIGS. 3 and 5) or integral with the main body (as shown in FIG. 6). A nebulizer 32 is designed in the shell, which can be comprised of a heater or a ultrasonic oscillator, depending on practical need, and its periphery is covered by a ring-shaped cover 33, which is made from a soft material of proper sealing and heat-resistance ability. Furthermore, a protective panel 34 is designed under the nebulizer 32. It is preferred to use a metal protective panel 34, but other proper electrical conductive materials can also be used. The protective panel 34 will be combined well with the aforesaid ring-shaped cover 33 tightly so as to keep a proper small gap between protective panel 34 and nebulizer 32 (as shown in FIGS. 5 and 6). Accordingly, when the nebulizer 32 is damaged by external impact and results in water leakage, the aforesaid protective panel 34 can hold the water and the water would not seep into the main body.

Figure 1:
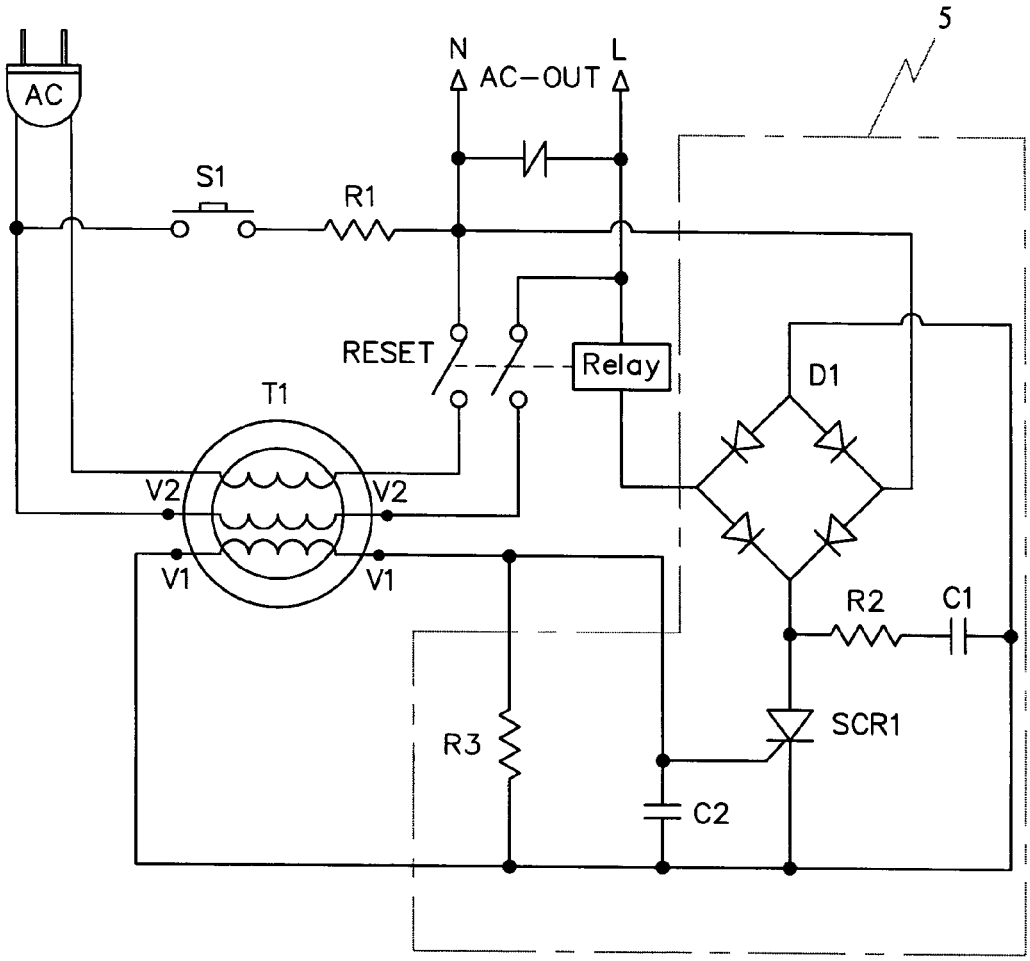
FIG 1 ( PRIOR ART )
FIG. 1 shows a conventional control circuit for cutting off power when water leakage occurs.
Figure 2:
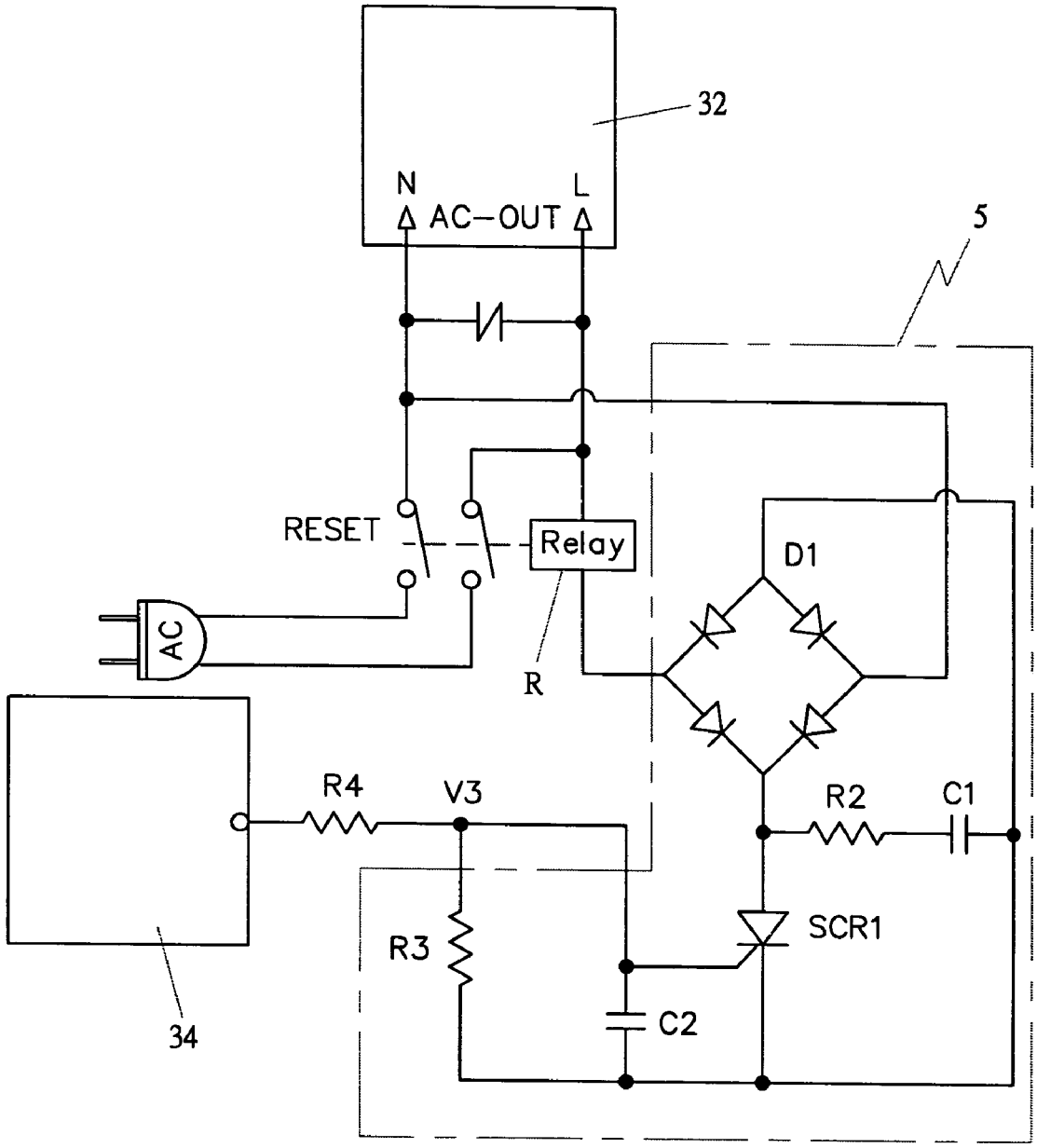
FIG. 2 shows a control circuit of the present invention for cutting off power when water leakage occurs.

In order to be able to quickly cut off the power in the case of water leakage in the nebulizer 32, the present invention provides a control circuit as shown in FIG. 2, in which a resistor R4 is electrically connected to the protective panel 34, and two terminals N and L in the control circuit are electrically connected to the nebulizer 32 respectively. So when the nebulizer 32 is under normal working state, two normally closed contacts N and C of relay R of the control circuit is closed, and the power can be supplied to the nebulizer 32 and make it operate normally. When the nebulizer 32 is damaged and water seeps into the protective panel 34, and that makes the protective panel 34 produce an electric potential and results in a change in the voltage V3 of resistor R4, that will drive the Silica Control Rectifier (SCR) and result in the action of relay R, so as to make the abovementioned two normally closed contracts N and C open, and cut off the power of nebulizer 32 for water leakage protection.

What the claimed is:

1. An atomization device having a safety protection device and a control circuit comprising:

a main body; a water tank designed in the main body, a water outlet valve designed at a bottom wall of the water tank; and an atomization room designed in the main body, an atomization groove provided under the atomization room;

wherein the safety protection device is designed at the atomization groove, and has a shell enclosing a nebulizer and a protective panel positioned below the nebulizer, the nebulizer and the protective panel are separately connected to the control circuit, but not directly connected to a same electrode of the control circuit, so that when the nebulizer is damaged and water seeps into the protective panel, the protective panel will produce an electric potential which will drive the control circuit to cut off the power of the nebulizer.

2. The atomization device, as recited in claim 1, wherein the shell of the safety protection device has an upper cover and a lower cover.

3. The atomization device, as recited in claim 2, wherein the shell of the safety protection device is detachable from the main body.

4. The atomization device, as recited in claim 2, wherein the upper cover of the shell of the safety protection device is integral with the main body.

5. The atomization device, as recited in claim 1, wherein a periphery of the nebulizer of the safety protection device is covered by a ring-shaped cover.

6. The atomization device, as recited in claim 5, wherein a gap is kept between the protective panel and the nebulizer.

7. An atomization device having a safety protection device and a control circuit comprising:

a main body;

a water tank coupled to the main body;

an atomization room coupled to the main body, an atomization groove provided under the atomization room;

wherein the safety protection device is provided in the atomization groove, and has a shell enclosing a nebulizer and a protective panel positioned below the nebulizer;

wherein the control circuit comprises a resistor electrically connected to the protective panel, two terminals electrically connected to the nebulizer and controlled by a relay, and a driving circuit electrically connected to the resistor and the relay.

8. The atomization device, as recited in claim 7, wherein the shell of the safety protection device has an upper cover and a lower cover.

9. The atomization device, as recited in claim 7, wherein the shell of the safety protection device is detachable from the main body.

10. The atomization device, as recited in claim 8, wherein the upper cover of the shell is made integral with the main body.

11. The atomization device, as recited in claim 7, wherein a periphery of nebulizer of the safety protection device is covered and fastened by a ring-shaped cover.

12. The atomization device, as recited in claim 7, wherein a predetermined gap is kept between the protective panel and the nebulizer.

13. The atomization device, as recited in claim 7, wherein the water tank has a water outlet valve at its bottom wall, the main body has a hollow post positioned under the water tank, and an inspection sensor is positioned in the hollow post.

* * * * *